US008647147B2

(12) United States Patent
Chartrand et al.

(10) Patent No.: US 8,647,147 B2
(45) Date of Patent: Feb. 11, 2014

(54) DUAL CONDUCTOR CABLE CONNECTOR

(75) Inventors: Mathieu Chartrand, Lery (CA); Frederic Boucher, Lemoyne (CA); Christopher Warnock, Beaconsfield (CA); Carlos Carpintero, Saint-Laurent (CA)

(73) Assignee: NII Northern International Inc., Coquitlam (CA)

( * ) Notice: Subject to any disclaimer, the term of this patent is extended or adjusted under 35 U.S.C. 154(b) by 71 days.

(21) Appl. No.: 12/720,353

(22) Filed: Mar. 9, 2010

(65) Prior Publication Data

US 2011/0223798 A1 Sep. 15, 2011

(51) Int. Cl.
*H01R 4/24* (2006.01)

(52) U.S. Cl.
USPC ..... 439/425; 439/444

(58) Field of Classification Search
USPC ..... 439/425, 426, 417–419, 395–405, 444, 439/468
See application file for complete search history.

(56) References Cited

U.S. PATENT DOCUMENTS

| | | | | | |
|---|---|---|---|---|---|
| 3,115,541 | A | | 12/1963 | Hanner et al. | |
| 3,821,691 | A | * | 6/1974 | Reimer | 439/391 |
| 4,027,096 | A | * | 5/1977 | Waddington et al. | 174/563 |
| 4,070,082 | A | | 1/1978 | Werner | |
| 4,097,104 | A | * | 6/1978 | Furey et al. | 439/269.1 |
| 4,283,104 | A | * | 8/1981 | Pemberton | 439/395 |
| 4,516,822 | A | * | 5/1985 | Wolfel | 439/468 |
| 4,648,674 | A | * | 3/1987 | Sanchez, Jr. | 439/395 |
| 4,749,367 | A | * | 6/1988 | Fraser | 439/417 |
| 4,793,824 | A | * | 12/1988 | Cozzens et al. | 439/395 |
| 4,861,278 | A | * | 8/1989 | McBride et al. | 439/395 |
| 4,902,245 | A | * | 2/1990 | Olsson | 439/492 |
| 4,915,650 | A | * | 4/1990 | Daly et al. | 439/498 |
| 4,921,439 | A | | 5/1990 | Bofill et al. | |
| 4,921,442 | A | * | 5/1990 | Puerner | 439/499 |
| 4,941,844 | A | * | 7/1990 | Bowden et al. | 439/425 |
| 4,973,263 | A | * | 11/1990 | Nielsen | 439/438 |

(Continued)

*Primary Examiner* — Amy Cohen Johnson
*Assistant Examiner* — Vladimir Imas
(74) *Attorney, Agent, or Firm* — McAndrews, Held & Malloy, Ltd.

(57) ABSTRACT

A connector assembly for use with dual conductor cable is disclosed. The connector assembly includes a first connector, a second connector, first and second fixture wires, and first and second connector terminals. The first and second connectors are removably attachable. The first connector includes a first connector base, two prongs extending from the first connector base, and a first connector slot for accepting the first connector terminal. The second connector includes a second connector base, two wings extending from the second connector base, and a second connector slot for accepting the second connector terminal. The wings are sized and configured to accept the two prongs when the first and second connectors are joined. The first and second connector terminals include a spike extending generally away from the base of the connector into which the terminal has been secured. The first connector terminal is secured in the first connector in electrical communication with the first fixture wire, and the second connector terminal is secured in the second connector in electrical communication with second fixture wire. The first and second connectors, when joined by the insertion of the prongs between the wings, define a central portion sized to allow the passage of the dual conductor cable to which the first and second connectors are connected. When the first and second connectors are joined with the dual connector cable located in the central portion, the spikes of the first and second terminals penetrate into the dual conductor cable, whereby the dual conductor cable is placed into electrical communication with the first and second fixture wire.

11 Claims, 5 Drawing Sheets

(56) References Cited

U.S. PATENT DOCUMENTS

| | | | | | |
|---|---|---|---|---|---|
| 5,080,604 | A | * | 1/1992 | Rider et al. | 439/357 |
| 5,080,606 | A | * | 1/1992 | Burkard | 439/403 |
| 5,174,783 | A | * | 12/1992 | Stassen et al. | 439/410 |
| 5,219,303 | A | * | 6/1993 | Daly et al. | 439/422 |
| 5,378,171 | A | * | 1/1995 | Czerlanis | 439/425 |
| 5,450,664 | A | * | 9/1995 | Babow et al. | 29/866 |
| 5,839,911 | A | * | 11/1998 | Dinkel | 439/470 |
| 6,037,679 | A | * | 3/2000 | Pirillo | 307/125 |
| 6,450,844 | B1 | | 9/2002 | Mizumura et al. | |
| 6,558,184 | B1 | * | 5/2003 | Melocchi et al. | 439/419 |
| 7,377,813 | B2 | * | 5/2008 | Pentell et al. | 439/620.26 |
| D603,804 | S | | 11/2009 | Urano | |
| 7,645,173 | B2 | * | 1/2010 | Larkin | 439/781 |
| 7,731,521 | B2 | * | 6/2010 | Corradi et al. | 439/417 |
| 7,740,511 | B2 | | 6/2010 | Katano | |
| D636,344 | S | | 4/2011 | Naito | |
| 2010/0002419 | A1 | | 1/2010 | Naito | |
| 2010/0203752 | A1 | | 8/2010 | Urano | |
| 2010/0267289 | A1 | | 10/2010 | Urano | |

* cited by examiner

DUAL CONDUCTOR CABLE CONNECTOR

CROSS-REFERENCE TO RELATED APPLICATION

None.

STATEMENT REGARDING FEDERALLY SPONSORED RESEARCH OR DEVELOPMENT

None.

BACKGROUND OF THE INVENTION

The present invention relates to connectors for providing power to a dual conductor cable.

Dual conductor cables are used, for example, in outdoor lighting applications to provide a relatively low voltage power supply to lighting fixtures, without the need for burying cables underground in conduit, and without the need for an outlet at each connection point. Connectors may be used to provide power from dual conductor cable at a point of interest by attaching directly to the cable without use of a pre-installed outlet along the length of a cable. In such an application, the insulation of the dual conductor cable is pierced so that a connection to the cable can be provided at many different locations along its length. While some presently known systems use connectors that pierce the insulation of dual conductor cables, these systems are often difficult to use, and inconvenient to attach and/or remove from the dual conductor cable. These types of connectors may be used outside, where cold and inclement weather, as well as prolonged exposure to the elements, add to the inconvenience of using certain presently known connectors.

It is therefore one object of the present invention, for example, to provide a reliable, convenient, and easy to attach and/or remove connector for use with dual conductor cable.

BRIEF SUMMARY OF THE INVENTION

A connector assembly for use with dual conductor cable is disclosed in certain embodiments of the present invention. The connector assembly includes a first connector, a second connector, first and second fixture wires, and first and second connector terminals. The first and second connectors are removably attachable. The first connector includes a first connector base, two prongs extending from the first connector base, and a first connector slot for accepting the first connector terminal. The prongs are substantially parallel, and define a first width across the outside of the prongs. The second connector includes a second connector base, two wings extending from the second connector base, and a second connector slot for accepting the second connector terminal. The wings define a second width across the inside of the wings, and the wings are sized and configured to accept the two prongs when the first and second connectors are joined. The first and second connector terminals include a spike extending generally away from the base of the connector into which the terminal has been secured. The first connector terminal is secured in the first connector in electrical communication with the first fixture wire, and the second connector terminal is secured in the second connector in electrical communication with the second fixture wire. The first and second connectors, when joined by the insertion of the prongs between the wings, define a central portion sized to allow the passage of the dual conductor cable to which the first and second connectors are connected. When the first and second connectors are joined with the dual connector cable located in the central portion, the spikes of the first and second terminals penetrate into the dual conductor cable, whereby the dual conductor cable is placed into electrical communication with the first and second fixture wires.

The wings and prongs may be sized and configured to resiliently and snappably connect together. Further, the prongs may include serrated protrusions extending from an outer surface to a width greater then the second width of the wings, wherein the serrated protrusions cooperate with at least one back surface of the wings to secure the first and second connectors together. Additionally, an internal guide, or a plurality of guides, may extend from the first and/or second connector bases.

Further, each of the first and second terminals may include a fixture wire spike located in a fixture wire slot. The fixture wire spike penetrates the first or second fixture wire to provide electrical communication with the first or second terminal. Also, the wings may extend further away from the second connector base at a second elevation than they do at a first elevation, and/or may include cutouts configured to provide access to the ends of the prongs when the connectors are joined. Additionally, the connector bases may be substantially disc shaped and include ridges configured to provide grip to the digit of an operator joining the first and second connectors together.

In certain embodiments of the present invention, a connector assembly for use with a dual conductor cable is provided. The connector assembly includes first and second removably attachable connectors, first and second connector terminals and first and second fixture wires. The first connector includes a first connector base, a first connector mounting feature that extends from the first connector base, and a first connector slot that accepts the first connector terminal. The second connector includes a second connector base, a second connector mounting feature that extends from the second connector base, and a second connector slot for accepting the second connector terminal. The second connector mounting feature is configured to cooperate with the first connector mounting feature to position the first and second connectors when the first and second connectors are joined. The first and second connector terminals include a spike that extends generally away from the base the terminal is secured to. The first connector terminal is in electrical communication with the first fixture wire, and the second connector terminal is in electrical communication with the second fixture wire. The first and second connectors define a central portion sized to allow the passage of the dual conductor cable to which the first and second connectors may be connected when they are joined. The spikes of the first and second connect terminals penetrate into the dual conductor cable when the first and second connectors are joined with the dual connector cable located in the central portion, whereby the dual connector cable is placed into electrical communication with the first and second fixture wires. The first and second connectors may comprise features that cooperate to provide a positive stop to prevent the first and second connector terminals from contacting each other when the first and second connectors are urged together.

In certain embodiments of the present invention, a connector assembly for use with a dual conductor cable is provided. The connector assembly includes a male connector and a female connector. The male and female connectors are removably attachable to each other. The male connector includes a male connector base, a male connector mounting feature extending from the male connector base, a connector terminal, a slot for accepting the connector terminal, and a fixture wire. The fixture wire is in electrical communication with the connector terminal. The female connector includes a female connector base, a female connector mounting feature extending from the female base, a connector terminal, a fixture wire, and a slot for accepting the connector terminal. The female connector mounting feature is configured to accept the male connector mounting feature, and the connector terminal and fixture wire are in electrical communication. The connector terminals each include a spike extending generally away from the base of the connector to which the connector terminal is mounted. The male and female connectors, when joined, define a central portion sized to allow the passage of the dual conductor cable to which the connectors may be connected. The spikes of the connector terminals penetrate into the dual conductor cable when the connectors are joined with the dual connector cable located in the central portion, whereby the dual connector cable is placed into electrical communication with the fixture wires.

DETAILED DESCRIPTION

Figure 1:
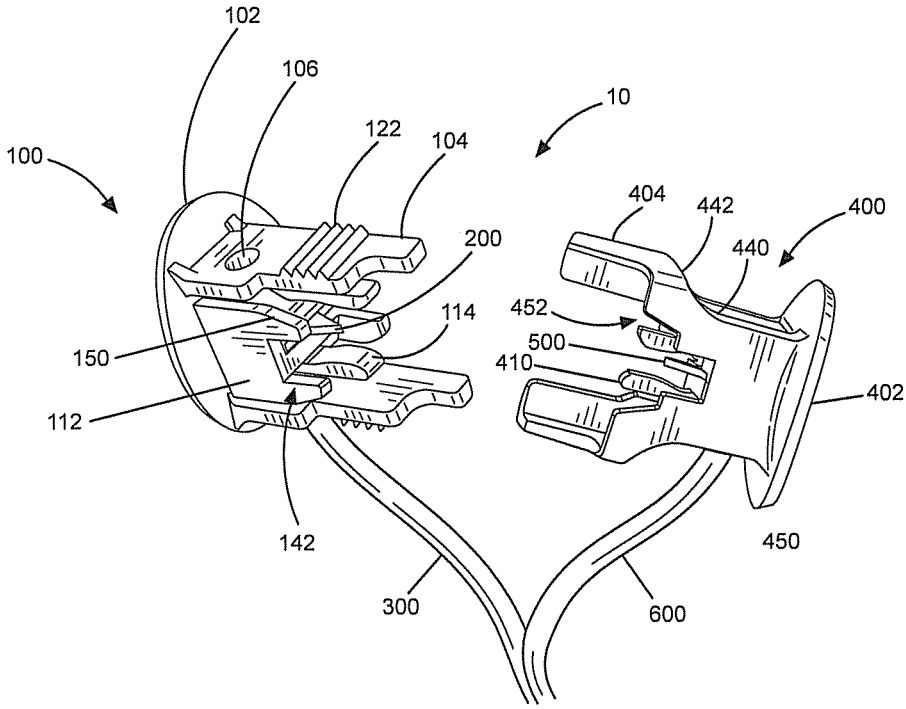
FIG. 1 is a perspective view of a connector system formed in accordance with an embodiment of the present invention, with the connectors separate.
Figure 2:
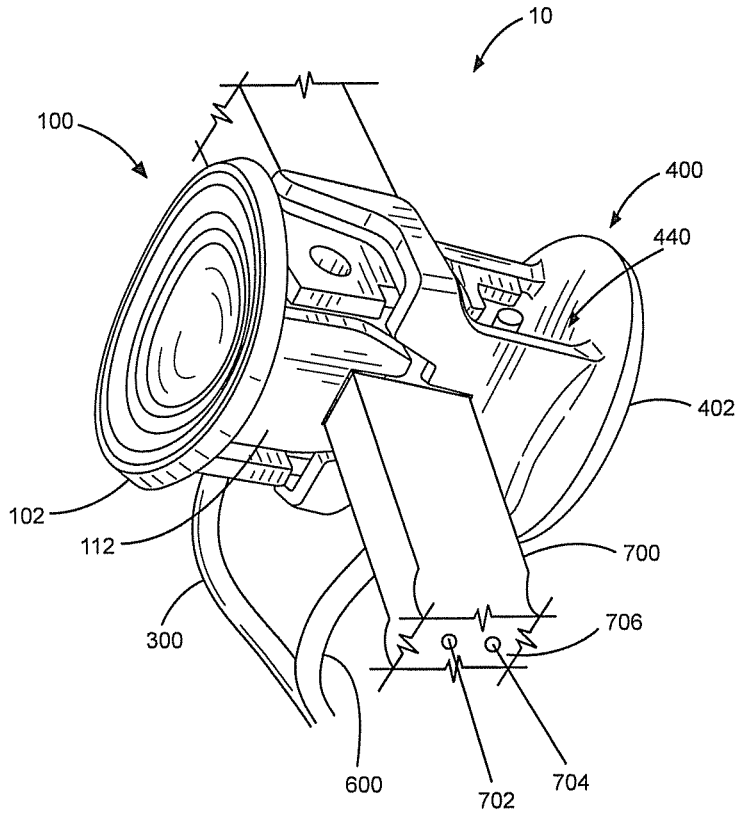
FIG. 2 is a perspective view of the connector system of FIG. 1 with the connectors joined about a dual conductor cable.
Figure 3:
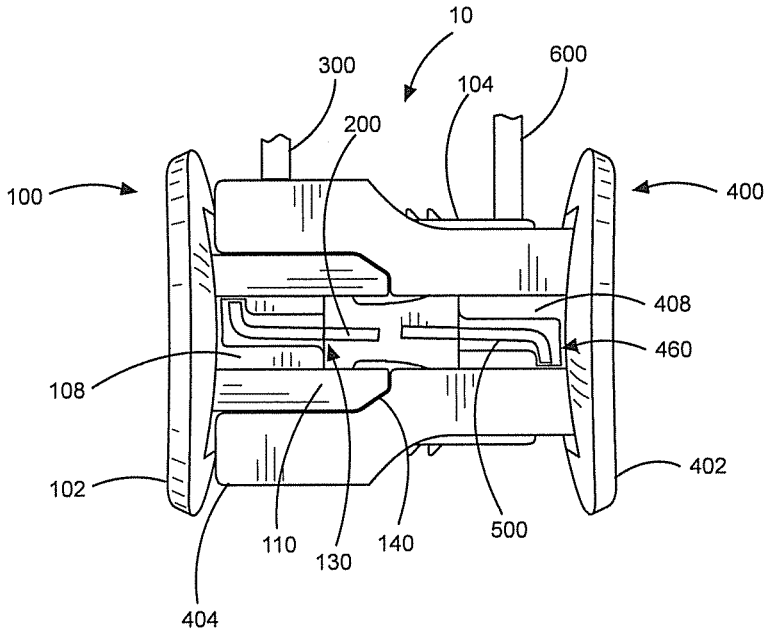
FIG. 3 is a plan view of the connector system of FIG. 1.
Figure 4:
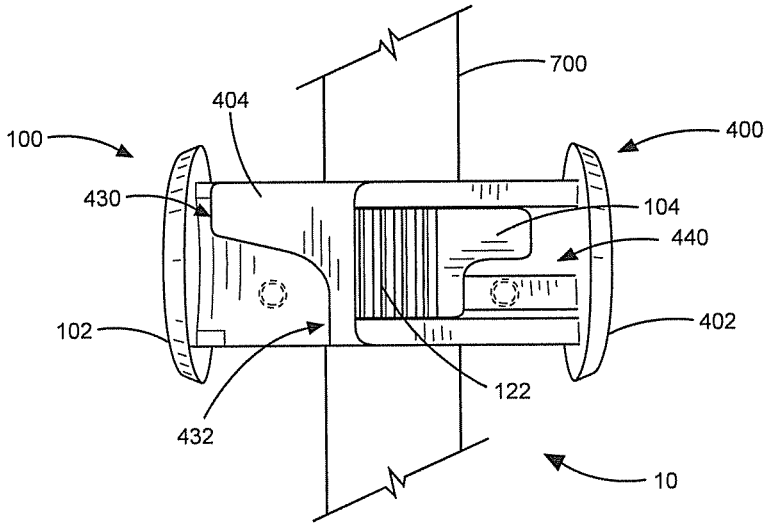
FIG. 4 is an elevation view of the connector system of FIG. 1 with the connectors joined about a dual conductor cable.

FIG. 1 presents a perspective view of a connector system 10 with its connectors separate, and FIG. 2 presents a perspective view of the connector system 10 with its connectors joined and surrounding a dual conductor cable 700. Further, FIG. 3 provides a plan view of the connector system 10 with its connectors joined (without a dual conductor cable), and FIG. 4 provides an elevation view of the connector system 10 with its connectors joined about a dual conductor cable. It should be noted that the terms "plan" and "elevation" are meant for convenience only in reference to the orientations shown in the figures, and that the connector system 10 in use may be rotated or oriented differently than the particular orientations illustrated. It should also be noted that embodiments of connectors formed in accordance with the present invention can take a variety of ornamental appearances, including those set forth in the drawings. In the illustrated embodiment, the connector system 10 includes a first connector 100, a first connector terminal 200, a first fixture wire 300, a second connector 400, a second connector terminal 500, and a second fixture wire 600. As discussed in further detail below, the first connector 100 and second connector 400 are joined about the dual conductor cable 700 to bring the dual conductor cable 700 into electrical communication with the first fixture wire 300 and the second fixture wire 600. In one embodiment, the dual conductor cable is a low voltage dual conductor cable for providing power to landscaping lighting, where one of the conductors is a positive lead and the other is a ground. In such an embodiment, one of the fixture wires is connected in electrical communication with the positive conductor, and the other fixture wire is connected in electrical communication with the ground conductor. The fixture wires lead to a landscape lighting fixture, which is thus provided with a voltage difference to provide power for lighting.

The first connector terminal 200 is secured in place in the first connector 100 in electrical communication with the first fixture wire 300. Thus, when the first connector terminal 200 is brought into electrical communication with a conductor of the dual conductor cable 700, the first fixture wire 300 is thereby brought into electrical communication with that conductor as well. Similarly, the second connector terminal 500 is secured in place in the second connector 400 in electrical communication with the second fixture wire 600. Thus, when the second connector terminal 500 is brought into electrical communication with a conductor of the dual conductor cable 700, the second fixture wire 600 is thereby brought into electrical communication with that conductor. As discussed in more detail below, in the illustrated embodiment, each of the conductor terminals 200, 500 include a spike that pierces the insulation of the dual conductor cable 700 when the first connector 100 and the second connector 400 are joined together about the dual conductor cable 700 to achieve electrical communication.

The first connector 100 includes a base 102, prongs 104, a fixture wire hole 106, a slotted terminal holder 108, top guides 110, a bottom guide 112, and staggered guides 114. In the illustrated embodiment, the prongs 104, top guides 110, bottom guides 112, and staggered guides 114 extend substantially perpendicularly from the base 102. As shown in FIGS. 1-4, the illustrated first connector 100 may also be considered a male connector that is accepted by the second connector 400. The first connector 100, as well as the second connector 400, are made of an electrically insulating material, such as, for example, polycarbonate, allowing an operator to handle the connectors safely.

The base 102 is a generally oval shaped disk sized and configured to provide a convenient surface for pressing against the outside of the first connector 100 with a thumb or finger to urge the first connector 100 into a mating connection with the second connector 400 and urge portions of the first and second connector terminals 200, 500 through the insulation of the dual conductor cable 700 when the connector system 10 is joined to the dual conductor cable 700. The illustrated base 102 includes a recessed external surface that includes ridges 120 to help provide grip, as well as to increase comfort and ease assembly.

The prongs 104 extend generally perpendicularly away from the base 102 and generally parallel to each other. The prongs 104 are an example of a mounting feature that cooperates with a mounting feature of another connector to secure the two connectors together. The prongs 104 may be made of a resilient material and sized and configured such that they may be biased, for example, inwardly using manual pressure, and return to their original orientation when the manual pressure is released. They are spaced apart, such that a width across their outside surfaces is defined. As will be discussed below as well, this width is sized to cooperate with features of the second connector 400 for joining the two connectors 100, 400. The prongs 104 include a fixture wire hole 106 that extends through the sides of the prongs. In the illustrated embodiment, the fixture wire hole 106 is located proximate the base 102. The fixture wire hole 106 is sized and positioned to allow the first fixture wire 300 to pass therethrough. The prongs 104 also include serrated protrusions 122 extending outwardly from the outside surfaces of the prongs 104. The serrated protrusions 122 are sized and positioned to cooperate with a feature of the second connector 400 to help secure the two connectors together after they have been joined.

The slotted terminal holder 108 extends away from the base 102 in generally the same direction as the prongs 104, but not as far. The slotted terminal holder 108 includes a terminal slot 130, a fixture wire hole (not shown), and a retention feature (not shown). The terminal slot 130 is generally "L" shaped (as best seen in FIG. 3) and extends from the top of the slotted terminal holder 108 (with the connector assembly 10 oriented as shown in FIGS. 1 and 2). The terminal slot 130 is sized and configured to accept the first connector terminal 200. The retention feature, for example, may be a protrusion in the terminal slot 130 sized and configured to cooperate with an indentation on the first connector terminal 200 to maintain the first connector terminal 200 in the terminal slot 130 after it has been placed in the terminal slot 130. The fixture wire hole is sized and positioned to accept the first fixture wire 300. The fixture wire hole is aligned with the fixture holes 106 of the prongs 104, and passes generally perpendicularly through the slotted terminal holder 108 and terminal slot 130, and a fixture wire may be inserted from either side of the first connector 100. Thus, when the first connector terminal 200 is placed in the terminal slot 130, the first connector terminal 200 may be electrically connected to the first fixture wire 300 that has been placed through the fixture wire hole.

The top guides 110 extend generally away from the base 102 proximate the top of the first connector 100 (with the connector assembly 10 oriented as shown in FIGS. 1 and 2). The top guides 110 are sufficiently separated to allow placement and removal of the first terminal connector 200 in the terminal slot 130. The top guides 110 are sized and positioned to assist in guiding the first connector 100 and second connector 400 together, as well as to assist in guiding the dual connector cable 700 through the connectors being joined and holding the dual connector cable 700 in place while the connectors are joined and the terminals pierce the insulation of the dual connector cable 700. For example, an outer width taken across the outside surfaces of the top guides 110 may be sized and configured to cooperate with features of the second connector 400 (such as the wings as illustrated) to help guide the connectors together. In the illustrated embodiment, the top guides 110 include chamfers 140 that providing a leading edge to help guide the wings of the second connector 400 when the two connectors are joined. Further, an inner width taken across the inside surfaces of the top guides 110 may be sized to be slightly larger than a first width but smaller than a second width of the dual connector cable 700 to help position and maintain the dual connector cable 700 in proper orientation between the connectors. Further still, the top guides 110 may be configured to cooperate with features of the second connector 400 to provide a positive stop that prevents the terminals from contacting each other and/or contacting more than one wire of the dual conductor cable when the two connectors are urged together.

The bottom guide 112 extends generally away from the base 102 proximate the bottom of the first connector 100 (with the connector assembly 10 oriented as shown in FIGS. 1 and 2). The bottom guide 112 is sized and positioned to assist in guiding the first connector 100 and second connector 400 together, as well as to assist in guiding the dual connector cable 700 through the connectors being joined and holding the dual connector cable 700 in place while the connectors are joined and the terminals pierce the insulation of the dual connector cable 700. For example, an outer width taken across the outside surfaces of the bottom guide 112 may be sized and configured to cooperate with features of the second connector 400 (such as the wings as illustrated) to help guide the connectors together. In the illustrated embodiment, the bottom guide 112 includes chamfers 150 that providing a leading edge to help guide the wings of the second connector 400 when the two connectors are joined. Further, the illustrated bottom guide 112 includes an opening 142 that may be sized to be slightly larger than a first width but smaller than a second width of the dual connector cable 700 to help position and maintain the dual connector cable 700 in proper orientation between the connectors. Further still, the bottom guide 112 may be configured to cooperate with features of the second connector 400 to provide a positive stop that prevents the terminals from contacting each other and/or contacting more than one wire of the dual conductor cable when the two connectors are urged together.

The staggered guides 114 extend generally away from the base 102, and are located at different widths and elevations from each other relative to the base 102. The staggered guides 114 are sized and positioned to help guide the dual connector cable 700 into a proper orientation within the connectors when they are joined, and to help secure the dual connector cable 700 in place while its insulation is pierced by portions of the terminals. As shown in FIG. 4, for example, the staggered guides 114 are spaced at a width slightly less than the top guides 110 or opening 142 in the bottom guide 112 to provide a more secure grip on the dual conductor cable 700. For example, the staggered guides may be positioned at a width slightly less then a width of the dual connector cable 700, such that the insertion of the dual conductor cable 700 between the staggered guides 114 resiliently biases the staggered guides slightly outward, thereby helping to secure the dual conductor cable 700 in place.

The second connector 400 includes a base 402, wings 404, a slotted terminal holder 408, and staggered guides 410. In the illustrated embodiment, the wings 404 and staggered guides 410 extend substantially perpendicularly from the base 402. As shown in FIGS. 1-4, the illustrated second connector 400 may also be considered a female connector that accepts the male connector 100.

The base 402, similar to the base 102 of the second connector 100, is a generally oval shaped disk sized and configured to provide a convenient surface for pressing against the outside of the second connector 400 with a thumb or finger to urge the second connector 400 into a mating connection with the first connector 100 and urge portions of the first and second connector terminals 200, 500 through the insulation of the dual conductor cable 700 when the connector system 10 is joined to the dual conductor cable 700. The illustrated base 402 includes a recessed external surface that includes ridges (not shown) to help provide grip, as well as to increase comfort and ease assembly.

The wings 404 extend generally perpendicularly away from the base 402 and generally parallel to each other. In the illustrated embodiment, the wings 404 are joined by common central portions at two different elevations. In alternate embodiments, the wings could be separate features extending from the base. The wings 404 are an example of a mounting feature that cooperates with a mounting feature of another connector to secure the two connectors together. The wings 404 may be made of a resilient material and sized and configured such that they may be biased, for example, outwardly using manual pressure, and return to their original orientation when the manual pressure is released. They are spaced apart, such that a width across their inside surfaces is defined. As will be discussed below as well, this width is sized to cooperate with features of the first connector 100 for joining the two connectors 100, 400. The wings 404 are sized and configured to help align and guide the prongs 104 of the first connector into place when the two connectors are joined.

The wings 404 of the illustrated embodiment extend away from the base 402 at two different elevations, a first elevation 430 and a second elevation 432. The wings extend farther from the base 402 at the first elevation 430 than at the second elevation 432. This shorter extension at the second elevation helps provide clearance for the first fixture wire 300 when the connectors are joined. The wings 404 also include side cutouts 440 that pass between the first elevation 430 and the second elevation 432 proximate to the base 402. The side cutouts 440 are sized and dimensioned to provide a passage for the second fixture wire 600, as well as to provide access to the prongs 104 when the connectors are joined. For example, when the connectors are joined, an operator of the connector system 10 may access the tips of the prongs 104 to bias them inwardly and disengage the prongs 104 from the wings 404 so that the connectors may be separated. An edge of the side cutouts 440 defines a relatively thin, angled edge surface 442 that may cooperate with the serrated protrusions 122 of the prongs 104 to help retain the connectors together when they are joined. The wings 404 also include surfaces to assist in joining the connectors as well as retaining and/or positioning the dual conductor cable 700 when the surfaces are joined. For example, in the illustrated embodiment, the wings 404 form a cable guide 450 to help position the dual conductor cable 700, and a guide surface 452 that cooperates with the bottom guide 112 of the first connector 100 to help guide the two connectors together when they are joined. Also, the illustrated wings 404 are separated at the first elevation 430 proximate to the base 402 to allow access to the second connector terminal 500. Further, the guide surface 452 may be configured to cooperate with the bottom guide 112 of the first connector 100 to provide a positive stop that prevents the terminals from contacting each other and/or contacting more than one wire of the dual conductor cable when the two connectors are urged together. Additionally or alternatively, the second connector 400 may comprise additional guide surfaces that cooperate with the top guides 110 and/or other features of the first connector 100 to provide a positive stop that prevents the terminal from contacting each other and/or contacting more than one wire of the dual conductor cable when the two connectors are urged together.

The slotted terminal holder 408 extends away from the base 402 in generally the same direction as the wings 404, but not as far. The slotted terminal holder 408 includes a terminal slot 460, a fixture wire hole (not shown), and a retention feature (not shown). The terminal slot 460 is generally "L" shaped (as best seen in FIG. 3) and extends from the top of the slotted terminal holder 408 (with the connector assembly 10 oriented as shown in FIGS. 1 and 2). The terminal slot 460 is sized and configured to accept the second connector terminal 500. The retention feature, for example, may be a protrusion in the terminal slot 460 sized and configured to cooperate with an indentation on the second connector terminal 500 to maintain the second connector terminal 500 in the terminal slot 460 after it has been placed in the terminal slot 460. The fixture wire hole is sized and positioned to accept the second fixture wire 600, and passes generally perpendicularly through the slotted terminal holder 408 and terminal slot 460. Thus, when the second connector terminal 500 is placed in the terminal slot 460, the second connector terminal 500 may be electrically connected to the first fixture wire 600 that has been placed through the fixture wire hole.

The staggered guides 410 extend generally away from the base 402, and are located at different widths and elevations from each other relative to the base 402 (with the connector assembly 10 oriented as shown in FIGS. 1 and 2). The staggered guides 410 are sized and positioned to help guide the dual connector cable 700 into a proper orientation within the connectors when they are joined, and to help secure the dual connector cable 700 in place while its insulation is pierced by portions of the terminals. As shown in FIG. 4, for example, the staggered guides 410 are spaced at a width slightly less than the top guides 110 or opening 142 in the bottom guide 112 of the first connector 100 to provide a more secure grip on the dual conductor cable 700. For example, the staggered guides 410 may be positioned at a width slightly less then a width of the dual connector cable 700, such that the insertion of the dual conductor cable 700 between the staggered guides 410 resiliently biases the staggered guides slightly outward, thereby helping to secure the dual conductor cable 700 in place.

Figure 5:
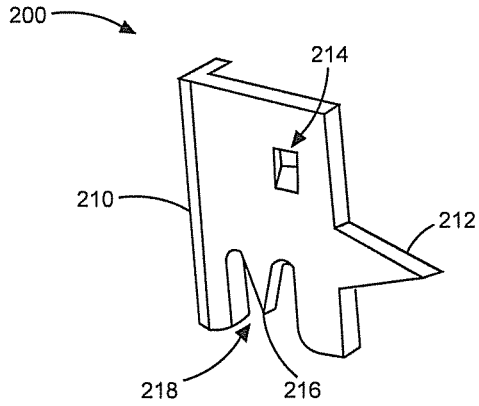
FIG. 5 is a perspective view of a terminal formed in accordance with an embodiment of the present invention.
Figure 6:
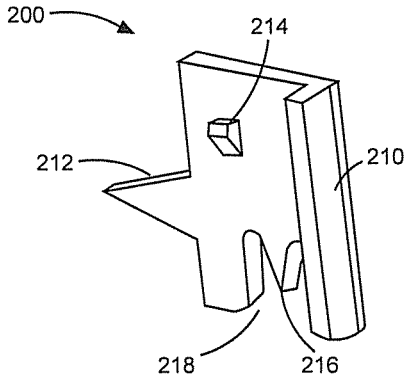
FIG. 6 is a perspective view of a terminal faulted in accordance with an embodiment of the present invention.

FIGS. 5 and 6 provide perspective views of the first terminal 200 of the illustrated embodiment. The second terminal 500 may be substantially similarly shaped to the first terminal 200. The terminals are made of an electrically conducting material, for example, brass or copper alloy. The first terminal includes a terminal body 210, a dual conductor spike 212, a retention feature 214, a fixture wire spike 216, and a fixture wire slot 218. The terminal body 210 is generally "L" shaped and sized to be accepted by a terminal slot. In the illustrated embodiment, the terminal body 210 is configured such that it is accepted into the terminal slot so that the dual conductor spike 212 extends generally away from the base. The retention feature 214 of the first terminal 200 cooperates with a retention feature of the slotted terminal holder 108 to help secure the first terminal 200 in place. For example, the first terminal 200 may include a protrusion that cooperates with a detent in the slotted terminal holder 108. As another example, the first terminal 200 may include a detent that cooperates with a protrusion in the slotted terminal holder 108.

The dual conductor spike 212 extends from the terminal body 210 and is oriented so that it extends away from the base 102 when the first terminal 200 is positioned in the slotted terminal holder 108. The dual conductor spike 212 is sized and configured so that it is sharp enough and rigid enough to penetrate the insulation of the dual conductor cable 700 and make electrical contact with one of the conductors of the dual conductor cable 700 when the two connectors are brought together about the dual conductor cable 700. In the illustrated embodiment, the fixture wire spike 216 extends in a generally perpendicular direction from the direction of extension of the dual conductor spike 212. The fixture wire spike 216 is sized and configured to pierce the insulation of a fixture wire 300 in place in the first connector 100 when the first terminal 200 is placed into the slotted terminal holder 108. For example, in the illustrated embodiment, the fixture wire spike 216 is located in a shallow, recessed fixture wire slot 218 proximate to the bottom of the first terminal 200 (as oriented in FIGS. 5 and 6).

The fixture wires 300, 600 may be single conductor cable surrounded by insulation, such as, for example, 18 gauge SPT-1 wire with the conductors separated along a portion of their length proximate to the connector system. In the illustrated embodiment, one end of each fixture wire leads to a terminal of a lighting fixture, so that providing a voltage difference across the fixture wires lights the lighting fixture. One end of each fixture is accepted by a connector and placed in electrical contact with a terminal placed in the connector.

As seen, for example, in FIG. 2, the dual conductor cable 700 includes a first conductor 702, and second conductor 704, and insulation 706. In the illustrated embodiment, the dual conductor cable 700 may be connected to, for example, a 12-15V AC transformer, and the first conductor 702 and second conductor 704 have a voltage difference across them. Then, when the first terminal 200 (and therefore first fixture 300 as well) is brought into electrical contact with one of the first and second conductors 702, 704, and the second terminal 500 (and therefore the second fixture wire 600 as well) is brought into electrical contact with the other of the first and second conductors 702, 704, a voltage difference is provided across the first and second fixture wires 300, 600 which can be used to provide light from the fixture. In the illustrated embodiment, the dual conductor cable defines a first width 708 that spans the diameters of both conductors, and a second width 710 that spans one diameter of the conductors (with the conductors aligned). The differences in these widths may be used, in conjunction with, for example, the various guides and openings discussed above, to help properly position and align the dual conductor cable 700 between the housings so that each of the terminals pierces the insulation and comes into electrical contact with one, and only one, of the conductors of the dual conductor cable 700. For example, the connectors may be configured to accept a range of dual conductor cables, such as 18, 16, 14, and/or 12 gauge SPT-2W low voltage landscape wire.

One example of the use of the connector system 10 will now be discussed, in connection with use of the connector system 10 with an outdoor lighting system. First, the dual conductor cable 700 is connected to a 12-15V AC transformer. This relatively low voltage allows the dual conductor cable 700 to be used above ground, and without the need for conduit or outlets, to provide flexibility in the attachment points of connector systems and the lighting fixtures to which they lead. One end of the first fixture wire 300 is connected with one terminal of a lighting fixture (not shown), and one end of the second fixture wire 600 is connected with a different terminal of the lighting fixture. The free end of the first fixture wire 300 is positioned in the first connector 100, and the first terminal 200 is then positioned in the first connector 100 so that the first terminal 200 is brought into electrical contact with the first fixture wire 300. Similarly, the free end of the second fixture wire 600 is positioned in the second connector 400, and the second terminal 500 is then positioned in the second connector 400 so that the second terminal 500 is brought into electrical contact with the second fixture wire 600. Using the various guides and openings discussed above, the dual conductor cable 700 is then oriented and positioned between the first connector 100 and the second conductor 400. The connectors are urged together. As the connectors join, the wings 404 accept the prongs 104, and the terminal spikes come into contact with the insulation of the dual conductor cable 700. As the connectors are further urged together, the serrated protrusions of the prongs engage a surface of the wings, and the terminal spikes penetrate through the insulation so that each terminal is electrically connected to one, and only one, of the wires of the dual conductor cable. With the connectors so positioned, the dual conductor cable 700 is now electrically connected to the fixture wires, and the connectors are secured together in place. To detach the connectors, on operator can press inwardly on the prongs 104 (using the access provided by the cutouts of the wings) to disengage them from the wings 404. With the prongs 104 biased inwardly (and/or the wings 404 biased outwardly) the connectors may be urged apart and disengaged from each other and the dual conductor cable 700.

While particular embodiments of the invention have been shown, it will be understood that the invention is not limited thereto since modifications may be made by those skilled in the art, particularly in light of the foregoing teaching. It is therefore, the appended claims that define the true spirit and scope of the invention.

What is claimed is:

1. A connector assembly comprising:

a first connector including:

a first connector base, a first prong extending from the first connector base, wherein the first prong includes an inwardly facing side and outwardly facing side, and a second prong extending from the first connector base, wherein the second prong includes an inwardly facing side facing the inwardly facing side of the first prong and an outwardly facing side; and a second connector removably attachable to the first connector and including:

a second connector base, a first wing extending from the second connector base, configured to receive the first prong, and including an end distant from the second connector base and a cutout located between the second connector base and the end distant the second connector base, wherein the cutout of the first wing reveals a portion of the outwardly facing side of the first prong when the first connector is attached to the second connector, and a second wing extending from the second connector base, configured to receive the second prong, and including an end distant from the second connector base and a cutout located between the second connector base and the end distant the second connector base, wherein the cutout of the second wing reveals a portion of the outwardly facing side of the second prong when the first connector is attached to the second connector.

2. The connector assembly of claim 1, wherein:

the first connector comprises a first terminal slot configured to accept a first terminal; and the second connector comprises a second terminal slot configured to accept a second terminal.

3. The connector assembly of claim 2, further comprising:

the first terminal secured in the first terminal slot, wherein the first terminal includes a spike extending away from the first connector base; and the second terminal secured in the second terminal slot, wherein the second terminal includes a spike extending away from the second connector base.

4. The connector assembly of claim 3, wherein, when the first connector is attached to the second connector:

an aperture is formed between the first connector base and the second connector base;

the aperture is sized to accept a dual conductor cable;

the spike of the first terminal is arranged to penetrate a first conductor of the dual conductor cable; and the spike of the second terminal is arranged to penetrate a second conductor of the dual conductor cable.

5. The connector assembly of claim 4, further comprising:

a first fixture wire electrically connected to the first terminal; and a second fixture wire electrically connected to the second terminal.

6. The connector assembly of claim 1, wherein:

the outwardly facing side of the first prong includes serrations; and the outwardly facing side of the second prong includes serrations.

7. The connector assembly of claim 6, wherein, when the first connector is attached to the second connector:

the cutout of the first wing reveals the serrations of the first prong; and the cutout of the second wing reveals the serrations of the second prong.

8. The connector assembly of claim 7, wherein:

the cutout in the first wing includes an end distal from the second connector base;

an edge in the first wing is defined by the end distal from the second connector base in the cutout of the first wing;

the cutout in the second wing includes an end distal from the second connector base;

an edge in the second wing is defined by the end distal from the second connector base in the cutout of the second wing;

the serrations on the first prong cooperate with the edge in the first wing; and the serrations on the second prong cooperate with the edge in the second wing.

9. The connector assembly of claim 1, wherein:

the first wing includes an upper elevation and a lower elevation;

the first wing extends further away from the second connector base at the upper elevation as compared to the lower elevation;

the second wing includes an upper elevation and a lower elevation; and the second wing extends further away from the second connector base at the upper elevation as compared to the lower elevation.

10. The connector assembly of claim 1, wherein:

an outwardly facing side of the first connector base comprises a disc-shaped member including ridges to provide grip to a digit of an operator; and an outwardly facing side of the second connector base comprises a disc-shaped member including ridges to provide grip to a digit of the operator.

11. The connector assembly of claim 1, wherein:

the first connector includes staggered guides to guide a dual connector cable into a proper orientation when the first connector and the second connector are being attached; and the second connector includes staggered guides to guide the dual connector cable into a proper orientation when the first connector and the second connector are being attached.

* * * * *